United States Patent [19]

Graber et al.

[11] 4,148,254

[45] Apr. 10, 1979

[54] PLUNGER DRIVE CONNECTION IN BALE DENSITY CONTROL SYSTEM

[75] Inventors: Kurt Graber, Moundridge; George Yatcilla, Newton; Garold L. Fleming, Hesston, all of Kans.

[73] Assignee: Hesston Corporation, Hesston, Kans.

[21] Appl. No.: 882,133

[22] Filed: Feb. 28, 1978

[51] Int. Cl.[2] ..... B30B 1/06

[52] U.S. Cl. ..... 100/179; 100/43; 100/192

[58] Field of Search ..... 100/43, 191, 192, 179, 100/DIG. 8

[56] References Cited

U.S. PATENT DOCUMENTS

| | | | |
|---|---|---|---|
| 2,763,201 | 9/1956 | Hauswirth | 100/43 |
| 2,796,825 | 6/1957 | Kriegbaum | 100/43 |
| 3,121,387 | 2/1964 | Fuhrwerk | 100/43 |

*Primary Examiner*—Billy J. Wilhite

*Attorney, Agent, or Firm*—Schmidt, Johnson, Hovey & Williams

[57] ABSTRACT

Pressurized fluid for the squeeze cylinders of an "extrusion" baler is supplied by a single-acting pump cylinder that is connected between the plunger head and its push rod in such a way as to deliver a slug of pressurized fluid into the circuit on each compression stroke of the plunger, the pump drawing in a fresh slug from a reservoir during each retraction stroke of the plunger. The push rod is connected to the plunger in a cranked relationship so that the radial distance between the end of the push rod and the fulcrum point of the crank comprises one lever arm, such lever arm being many times smaller than the lever arm between the fulcrum point and the point of connection of the crank of the pump cylinder.

11 Claims, 7 Drawing Figures

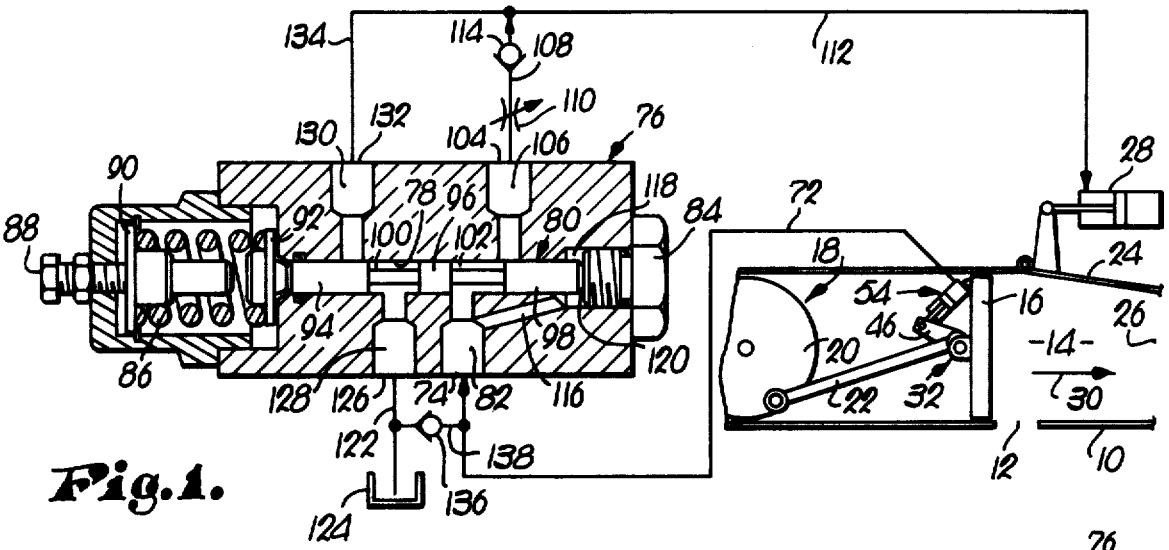
Fig.1.
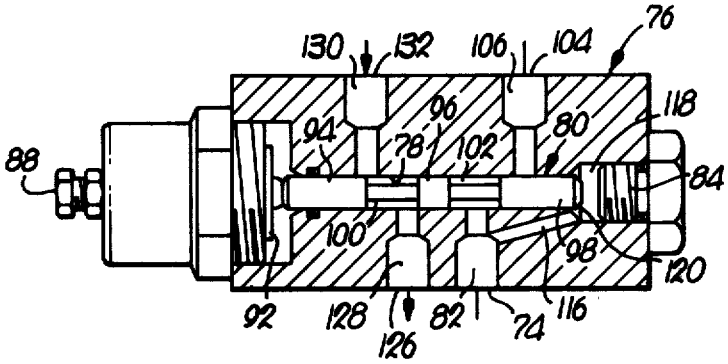
Fig.2.
Fig.3.
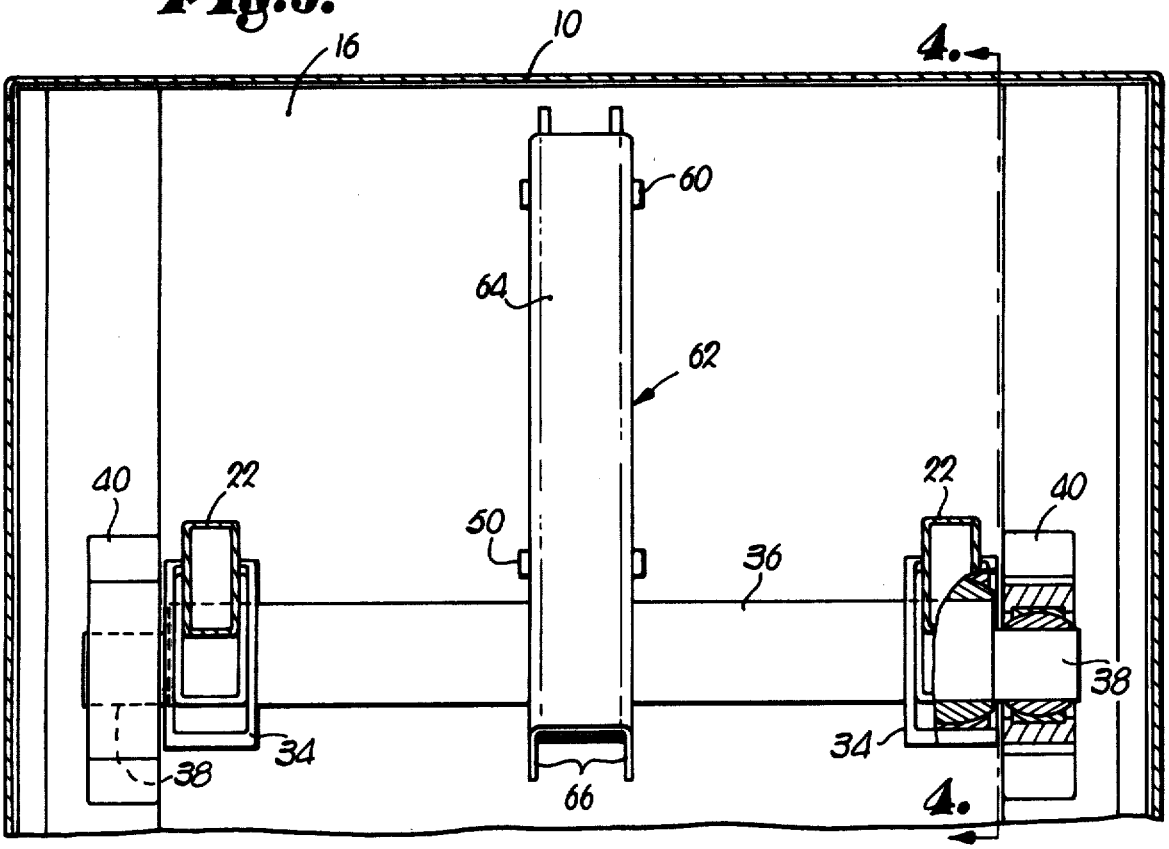

PLUNGER DRIVE CONNECTION IN BALE DENSITY CONTROL SYSTEM

TECHNICAL FIELD

This invention relates to controlling the density of bales produced in an extrusion-type baler wherein successive charges of material are introduced into a baling chamber and are forced through a restricted orifice by a reciprocating plunger.

BACKGROUND ART

Typical prior control systems for this class of baler have relied upon mechanical sensors which activate a hydraulic control circuit for cylinders that control the size of the orifice, such sensors normally activating the circuits to either relieve or add fluid pressure depending upon the extent to which the sensors can penetrate the forming bale. In other words, the "tightness" or density of the forming bale results in the sensor being physically positioned in such a way that it performs an appropriate valving function so as to either further pressurize or depressurize the squeeze cylinders.

However, systems of this type rely upon very localized "readings" of bale density and, thus, may not accurately reflect the overall or average density of the bale being formed. Hence, the degree of uniformity of density throughout the bale may suffer.

SUMMARY OF THE INVENTION

Rather than sense bale density on a local, concentrated basis in the foregoing manner, a preferred way is to sense pressure buildup in the hydraulic circuit that controls the squeeze cylinders and to then take such corrective steps as may be necessary in response to that buildup, such being possible as a way to provide the necessary control function inasmuch as the pressure buildup in the circuit is directly related to the resistance encountered by the bale as it attempts to move through the orifice under the impetus of the plunger. Thus, by basing the control system on resistance to bale movement rather than depth of penetration at any localized spot in the bale, the condition of the bale as a whole is more fully considered, to the end that adjustments which more accurately reflect the state of things can be automatically effected.

During each plunger compression stroke, a special pumping cylinder, operated by the plunger head as it encounters resistance to its stroke, forces a slug of fluid into the hydraulic control circuit, which is either added to the squeeze cylinders or blocked from entering the same, depending upon the existing pressure level in the circuit, as determined by the density of the bale being formed. To accomplish this pumping stroke on the pump during each plunger stroke, the push rod is connected to the plunger in such a way that there is some initial lost-motion of the push rod relative to the plunger head, during which the pumping stroke occurs. Such lost-motion could be obtained by merely connecting the push rod, pump cylinder and plunger head together in a "direct line" arrangement, but the high force loadings experienced by the push rod create problems when this is transformed into fluid pressure within the control circuit. That is, in many respects, it is desirable to work with the smallest pump cylinder possible for expense reasons, yet if a small cylinder is connected in line with the push rod, the force loadings on the pump cylinder will be so high that the resulting pressure in the hydraulic system from the small diameter ram of the pump cylinder will simply be far too excessive. A way to avoid this is to provide a large diameter pump cylinder so that, while the force applied against the ram of the cylinder by the push rod may be just as high as with a small diameter cylinder, the resulting pressures will be significantly lower. This has the drawback, however, of increased weight, space requirements and cost.

As an attractive alternative to the above solution, the present invention contemplates reducing the force applied by the push rod to the pump cylinder through a leverage arrangement without sacrificing the total force applied against the plunger head. To this end, the push rod is connected to the plunger head via a short lever arm so that during the compression stroke, the push rod moves about the fulcrum point of the lever arm through a small arc. The pump cylinder, on the other hand, is connected at one end to the plunger head via a long lever arm, which is in turn joined with the first lever arm so that force from the push rod is ultimately transmitted out to the end of the long lever arm and, thus, to the pump cylinder. However, since the long lever arm is indeed so much longer than the short lever arm, to which the push rod is directly connected, the force seen by the pump cylinder is many times less than that experienced in the push rod itself, thereby permitting a satisfactorily small diameter pump cylinder to be utilized.

Even if the density control system of the present invention were to utilize some kind of an electromechanical system, which avoided the use of a pump cylinder as aforesaid, it is conceivable that the special leverage arrangement herein contemplated would still be of value because of the manner in which the force at the outer end of the second lever arm can be reduced to a level which can be tolerated by components that might be utilized in such an electromechanical system. Accordingly, the special leverage arrangement of the present invention has utility even where a pumping cylinder of the above-described type is not used.

BRIEF DESCRIPTION OF THE DRAWINGS

In the drawings:

FIG. 1 is a largely schematic view of a density control system according to the principles of the present invention;

FIG. 2 is an isolated view of a special valve forming a part of such system and showing the same actuated so as to relieve pressure in the squeeze cylinders;

FIG. 3 is an enlarged, transverse vertical cross-sectional view through the bale case and illustrating the manner in which the plunger is connected with its drive apparatus;

DETAILED DESCRIPTION OF THE INVENTION

Figure 5:
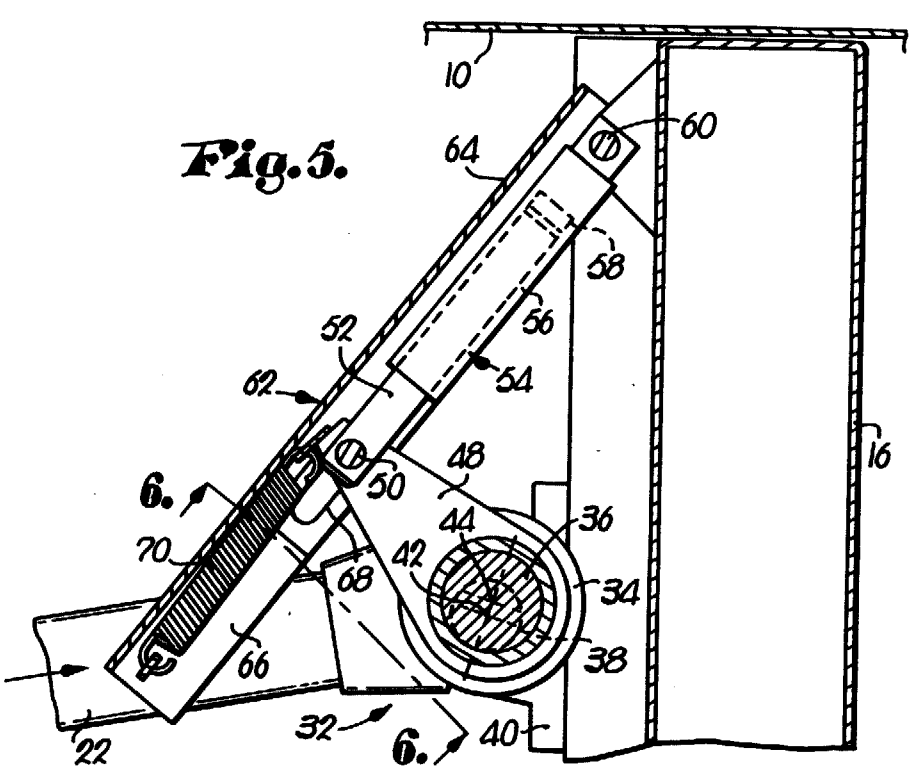
FIG. 5 is a view similar to FIG. 4, but with additional parts shown in cross section and illustrating the pump moved through a pump stroke.

As illustrated in FIG. 1, the bale case 10 has a lateral opening 12 through which material to be baled is introduced into the baling chamber 14. A plunger 16 is reciprocated within the chamber 14 by apparatus 18 that may take the form of a rotating drive wheel 20 and a pitman rod 22 disposed in cranked relationship to the axis of rotation of the wheel 20. Laterally shiftable structure which may take the form of a wall 24 of the bale case 10 cooperates with the remainder of the latter to define a discharge orifice 26 whose dimensions may be restricted relative to the remainder of the bale case 10 through one or more devices in the nature of a hydraulically powered "squeeze" cylinder 28 coupled mechanically with the shiftable wall 24. Thus, the reciprocating plunger 16 packs material through the bale case 10 in the direction of the arrow 30 and against the resistance afforded by the constricted nature of the orifice 26. The process is therefore akin to an extrusion operation.

Figure 4:
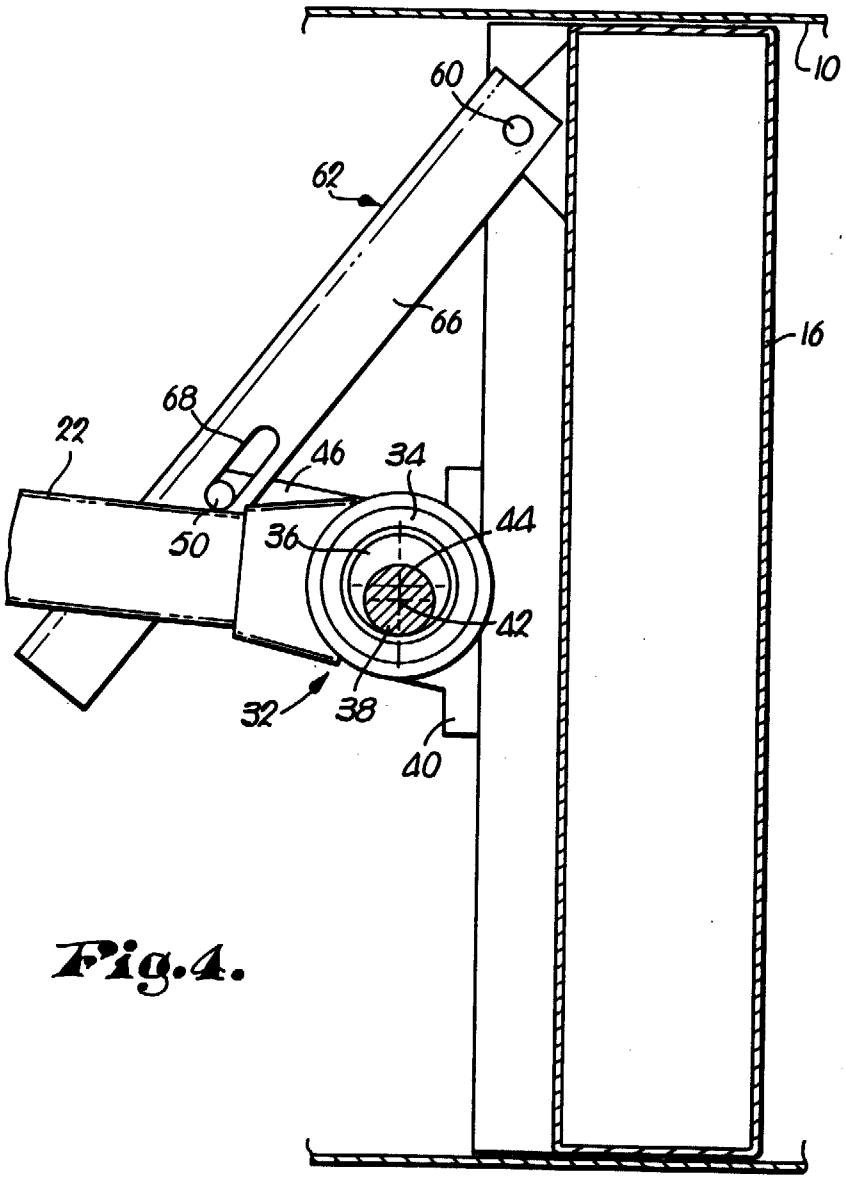
FIG. 4 is a vertical cross-sectional view thereof taken along line 4—4 of FIG. 3.

Referring now more specifically to FIGS. 3–6, the pitman rod 22 has a special lost-motion connection 32 with the plunger 16. In the preferred form, a pair of such rods 22 are utilized as illustrated in FIG. 3, and each of the rods 22 carries a bearing 34 that concentrically and rotatably receives the corresponding end of a rockshaft 36 extending across the back of the plunger 16. A pair of pintles 38 project outwardly from opposite ends of rockshaft 36 in eccentric relationship to the longitudinal axis thereof and are journaled by pillow bearings 40 rigidly affixed to the back of the plunger 16. As illustrated in FIGS. 4 and 5, the axis 42 of the pintles 38 thereby serves as the axis of rotation of the rockshaft 36 relative to the plunger 16, even though such axis 42 is eccentrically disposed with respect to the longitudinal axis 44 of rockshaft 36.

A pair of cranks 46 and 48 are rigidly affixed to the middle of the rockshaft 36 in slightly spaced-apart relationship along the latter. At their outer ends the cranks 46, 48 carry a cross pin 50 that bridges the cranks 46, 48 and is in turn pivotally connected to the rod 52 of a single-acting, rectilinear pump 54. Pump 54 further includes a cylinder 56 slidably receiving the ram 58 of rod 52 and connected at its upper end by pivot 60 to the plunger 16. Thus, cranks 46 and 48 reciprocate the ram 58 as the shaft 36 rocks.

The pump 54 is housed within an inverted, U-shaped channel 62 that is pivotally mounted on the plunger 16 via the pivot 60 of pump 54. The channel 62 includes a bight portion 64 overlying the pump 54 and a pair of depending legs 66 having aligned longitudinally extending slots 68 that receive the opposite ends of the cross pin 50. The stroke of pump 54 is thereby limited by the opposite terminal ends of the slots 68, and a return spring 70 is connected between the lower end of the channel 64 and the outer end of the crank 48 for the purpose of assuring that the rod 52 is withdrawn fully during a return stroke of the plunger 16.

Figure 7:
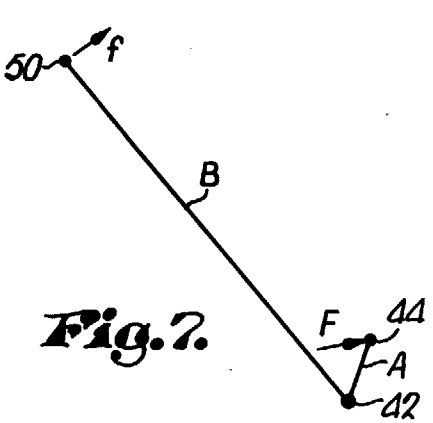
FIG. 7 is a diagrammatic view of the lever arms involved in the present invention.
Figure 6:
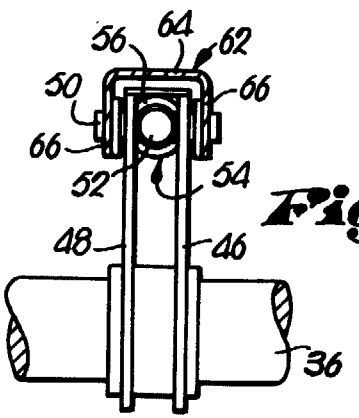
FIG. 6 is a fragmentary cross-sectional view taken substantially along line 6—6 of FIG. 5.

As a result of the special leverage arrangement above-described with respect to push rod 22, rockshaft 36 and cranks 46, 48, a pair of lever arms A and B are presented as illustrated diagrammatically in FIG. 7. The axis 42 of the pintles 38 serves as the common fulcrum for the two lever arms A and B, the shorter arm A representing the radial distance between the fulcrum 42 and the longitudinal axis 44 of the rockshaft 36. This outer end of the short lever arm A represents the point at which the push rod 22 is connected to the plunger head 16, and the force F from the push rod 22 is directed toward such outer point or axis 44.

The substantially longer lever arm B is defined by the radial distance between the pivot 50 and the fulcrum point 42, and because lever arm B is so much longer than lever arm A, the force f applied to the pump rod 52 at pivot 50 is proportionally smaller than the force F applied at the axis 44.

As illustrated in FIGS. 1 and 2, the cylinder 56 on the side of ram 58 opposite the rod 52 is connected with a hydraulic control circuit via a line 72 leading to a high pressure port 74 in a valve body 76. Port 74 communicates with a bore 78 in the body 76 that slidably receives a spool 80, such communication being by way of a passage 82. The spool 80 is yieldably biased in a rightward direction viewing FIG. 1 against a plug 84 by a compression spring 86 at the end of spool 80 opposite the plug 84. The extent of bias from the spring 86 may be adjusted by appropriately rotating adjusting screw 88 which bears against a plate 90 that in turn engages the proximal end of the spring 86 to compress the latter against an opposite plate 92 having engagement with the spool 80.

The spool 80 is provided with three lands 94, 96 and 98 separated by a pair of annular regions 100 and 102 on opposite sides of the land 96. When the spool 80 is in the position of FIG. 1 against the plug 84, the inlet port 74 is in communication with an outlet port 104 via a passage 106 leading from the region 102 that is in turn connected with the passage 82. A high pressure line 108 leads from the port 104 through a restricted port or orifice 110 and connects with a line 112 leading to the rod side of the squeeze cylinder 28, there being a check valve 114 in line 108 to permit flow in the latter only in a direction toward squeeze cylinder 28.

A pilot passage 116 extending diagonally through the valve body 76 from the passage 82 communicates the inlet port 74 with a pilot chamber 118 at the rightmost end of the bore 78. The right end of the spool 80 has a circumferential bevel 120 exposed to the fluid pressure within pilot chamber 118.

A dump line 122 of the circuit leading to reservoir 124 is connected to an outlet port 126 that communicates with region 100 via a passage 128. Central land 96 blocks communication between the passages 82 and 128 at all times, while land 94 controls communication between passage 128 and another passage 130 leading from port 132, the latter in turn being connected to the line 112 via a line 134. In a similar way, land 116 at the right end of the spool 80 controls communication of the passages 82 and 106 with one another. A check valve 136 in a short line 138 between lines 72 and 122 permits fluid flow between such lines only in the direction toward the pump 54 during negative displacement of the latter on a retraction or suction stroke.

Operation

The spool 80 is normally in its rightmost position of FIG. 1. This opens the rod side of the squeeze cylinder 28 to fluid from the pump 54 along an operating pressure path defined by line 72, port 74, passage 82, region 102, passage 106, port 104, line 108 and line 112. Thus, as the plunger 16 is shifted through a compaction stroke toward the right end of the bale case 10 viewing FIG. 1, a slug of oil is forced from the pump 54 along such operating path. The motion for the position displacement of the ram 58 of the pump 54 is, of course, derived from the nature of the lost-motion connection 32 between the pitman rod 22 and the plunger 16. Thus, the rockshaft 36 is rocked about the axis 42 in a clockwise direction viewing FIGS. 4 and 5 to correspondingly swing cranks 46, 48 and displace the pump rod 52 to the extent permitted by the right end of the slots 68 as viewed in FIGS. 4 and 5. Because the lever arm B is so much longer than the lever arm A, as illustrated in FIG. 7, even though the force F applied against the plunger head 16 by the push rods 22 may be relatively large, the force f applied by the cranks 46, 48 against the pump rod 52 to operate the same is many times smaller.

During such a pumping stroke on the part of the pump 54, the oil along the operating path has no choice but to flow to the squeeze cylinder 28, inasmuch as all routes to the reservoir 124 are blocked so long as the spool 80 remains in its FIG. 1 position. Note in this regard that the check valve 136 closes line 138 to the reservoir 124; land 96 closes off communication between passage 82 and passage 128; and, although line 134 may be pressurized, the fluid therein is prevented from dumping to the reservoir 124 by virtue of the blockage by land 94 of the passage 130.

On each retraction stroke of the plunger 16 in a leftward direction viewing FIG. 1, the pump 54 is drawn through a suction stroke by either the cranks 46, 48 operating alone or in conjunction with the return spring 70. In either event, the effect of this stroke is to unseat the check valve 136 so as to allow an increment of fluid to be drawn from the reservoir 124 through the line 138 and into the operating path of the circuit. Note that the check valve 114 in line 108 prevents the pump 54 from drawing any fluid out of the squeeze cylinder 28 at this time.

As a result of this pumping action on the part of the pump 54, the operating path is progressively pressurized to a greater and greater degree, thereby increasing the "squeeze" of the shiftable wall 24 on the bale that is being advanced through the chamber 14 by the reciprocating plunger 16. That, in turn, increases the resistance of the bale to advancement by the plunger 16, hence increasing the compactive force of the latter on the fresh charges of material entering through the inlet 12. The compactive force applied by the plunger 16 is likewise transmitted to the circuit through the pump 54 via its mechanical connection with the plunger 16.

Fluid pressure in the operating path is also transmitted to the pilot chamber 118 and hence to the bevel 120 on spool 80 via the pilot line 116. Once that pressure reaches a level sufficient to overcome the resistance of the spring 86, the spool 80 will be shifted leftwardly such as to the opposite extreme position illustrated in FIG. 2. This has the immediate effect of opening a pressure relief path from the squeeze cylinder 28 via the line 112, line 134, port 132, passage 130, region 100, passage 128, port 126 and line 122 into the reservoir 124. At the same time, the land 98 moves into blocking relationship to the passage 106 so that further pressurized fluid from the pump 54 will not be admitted to the squeeze cylinder 28. This, then, has the effect of relieving the squeeze on the bale emerging through the orifice 26 so as to in turn reduce the bale's resistance to movement by the plunger 16, thereby keeping the compactive force of the latter from exceeding a selected level that corresponds with the setting of the adjusting screw 88 against the compression spring 86.

Parenthetically, it should be noted that once land 98 blocks passage 106, pump 54 can no longer make a pumping stroke (or complete one that may have been started). Suitable relief valving (not shown) may be provided in line 72 set at a higher relief pressure than the pilot pressure necessary to shift spool 80 so as to avoid any excessive pressures in the circuit when this condition obtains.

Relief of the squeeze cylinder 28 will occur on the compression stroke of the plunger 16 at a time when the pump 54 attempts to add additional fluid into the operating path. Thus, as long as sufficient pressure from the pump 54 is present during a compaction stroke to maintain the spool 80 shifted leftwardly as in FIG. 2, the squeeze cylinder 28 will be relieved. Immediately upon beginning the retraction stroke of the plunger 16, the pressure in pilot chamber 118 will, of course, decrease so that the spring 86 will return the spool 80 to its original condition such that the squeeze cylinder 28 is no longer relieved. Moreover, relieving the squeeze cylinder 28 has the effect also of relieving the pressure in the pilot chamber 118 in view of the fact that the resistance to bale movement by the plunger 16 may be diminished slightly so as to accordingly reduce the pressure applied by the ram 58 of the pump 54.

Of importance is the fact that, in the preferred form, the squeeze cylinder 28 is normally operating at a lower pressure than that existing in the pilot chamber 118. This pressure differential is desirable due to the fact that the pressure required at the squeeze cylinder 28 to achieve a certain compressive force by the plunger 16 may fluctuate widely depending upon such things as moisture content and the nature of the materials being baled. For example, certain crops may exhibit a relatively high coefficient of friction with respect to their movement along the walls of the bale case 10. Thus, lower squeeze pressures would be required at the cylinder 28 in order to result in a certain compressive force by the plunger 16 than would be true with materials which would more easily slide through the bale case 10. In those latter instances, it would be necessary to squeeze the material more tightly in order to achieve the same resistance to movement and, thus, the same compressive or compactive force by the plunger 16.

To accommodate these fluctuations in applied pressure at the squeeze cylinder 28, then, it is preferred that the above-mentioned pressure differential be introduced between the squeeze cylinder 28 and the pilot chamber 118. This can be accomplished at least in part by careful calibration of the various ports along the operating path of the circuit (which includes the port 74, passage 82, region 102, passage 106 and port 104 in the valve body 76). The relationship between the leftmost end of land 98 and the passage 106 can be critical in this regard. Additionally, an orifice 110, preferably of the adjustable type, can be provided in the line 108 leading from port 104 so as to facilitate achievement of the desired differential.

For purposes of illustration only, it might be assumed, for example, that it is desired to cause leftward actuation of the spool 80 when the pressure in pilot chamber 118 reaches 3,000 P.S.I. This would correspond to a certain predetermined compressive force on the part of the plunger 16 and a corresponding loading on the pitman rods 22. In a typical situation under "normal" crop conditions, the pressure in squeeze cylinder 28 may be 1,500 P.S.I. Thus, in this situation, even if "abnormal" crop conditions are encountered throughout a day's operation (such as might be true comparing crop moisture conditions in the morning and afternoon), the pressure at squeeze cylinder 28 may fluctuate as may be required to achieve 3,000 P.S.I. in the pilot chamber 118. The result of this is that the user need select only a setting of the adjusting screw 88 that will result in a certain compactive force loading of the plunger 16. That loading will be automatically maintained throughout the day regardless of variations in crop conditions. Thus, the process is more fully automated than prior systems and greater uniformity of bale density is achieved.

We claim:

1. In a baler having a plunger and apparatus for reciprocating said plunger, the improvement comprising:

means defining a fulcrum point connected with the plunger;

means defining a first lever arm extending outwardly from said fulcrum point;

a force-transmitting connection between the outer end of said first lever arm and said apparatus;

means defining a second lever arm extending outwardly from said fulcrum point and having a radial length with respect to said fulcrum point that is greater than the corresponding radial length of said first lever arm, said lever arms being interconnected for transmitting force therebetween and for swinging movement in unison about said fulcrum point; and means at the outer end of said second lever arm for receiving force from said apparatus at a reduced level compared to that received at the outer end of said first lever arm.

2. In a baler as claimed in claim 1, wherein said means at the outer end of said second lever arm includes part of a control system regulating the density of bales produced by the baler.

3. In a baler as claimed in claim 2, wherein said part includes a fluid-pressure pump connected between said second lever arm and the plunger and operable in response to said reception of force through the second lever arm.

4. In a baler as claimed in claim 3, wherein said pump includes a ram and a cylinder reciprocably receiving said ram.

5. In a baler as claimed in claim 4, wherein said apparatus is provided with a rockshaft extending transversely of the path of travel of the plunger, said connection between the apparatus and said first lever arm including a bearing adapting the rockshaft for rotation relative to said apparatus about the longitudinal axis of the rockshaft, said rockshaft being connected to said plunger for rocking movement relative to the latter about an axis located at said fulcrum point whereby the rockshaft comprises said means defining said first lever arm.

6. In a baler as claimed in claim 5, wherein said rockshaft is provided with a crank connecting the same with said pump, said crank and said rockshaft cooperating to comprise said means defining a second lever arm.

7. In a baler as claimed in claim 6, wherein both of said lever arms are on the same side of said fulcrum point.

8. In a baler as claimed in claim 1, wherein both of said lever arms are on the same side of said fulcrum point.

9. In a baler as claimed in claim 1, wherein said apparatus is provided with a rockshaft extending transversely of the path of travel of the plunger, said connection between the apparatus and said first lever arm including a bearing adapting the rockshaft for rotation relative to said apparatus about the longitudinal axis of the rockshaft, said rockshaft being connected to said plunger for rocking movement relative to the latter about an axis located at said fulcrum point whereby the rockshaft comprises said means defining said first lever arm.

10. In a baler as claimed in claim 9, wherein said rockshaft is provided with a crank connecting the same with said means at the outer end of said second lever arm, said crank and said rockshaft cooperating to comprise said means defining a second lever arm.

11. In a baler as claimed in claim 10, wherein both of said lever arms are on the same side of said fulcrum point.

* * * * *